US007226319B2

(12) United States Patent
Woo

(10) Patent No.: US 7,226,319 B2
(45) Date of Patent: Jun. 5, 2007

(54) EARPHONE JACK AND MOBILE TERMINAL HAVING THE SAME

(75) Inventor: Jeon-Hyung Woo, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 81 days.

(21) Appl. No.: 11/248,582

(22) Filed: Oct. 11, 2005

(65) Prior Publication Data

US 2006/0089054 A1 Apr. 27, 2006

(30) Foreign Application Priority Data

Oct. 13, 2004 (KR) ..... 10-2004-0081898

(51) Int. Cl.
*H01R 24/04* (2006.01)

(52) U.S. Cl. ..... 439/668

(58) Field of Classification Search ..... 439/592, 439/593, 688, 689

See application file for complete search history.

(56) References Cited

U.S. PATENT DOCUMENTS 6,540,535 B1 * 4/2003 Zhu et al. ..... 439/188

6,851,975 B2 * 2/2005 VanEpps, Jr. ..... 439/592

* cited by examiner

*Primary Examiner*—Khiem Nguyen
(74) *Attorney, Agent, or Firm*—Lee, Hong, Degerman, Kang & Schmadeka

(57) ABSTRACT

An earphone jack and a mobile terminal having the same is provided so as to enable a plug to be smoothly inserted into or pulled out of an earphone jack regardless of diameter variations of the plug and the earphone jack without providing an additional part. To this end, an earphone jack comprises a housing having at its center, an insertion hole into which a plug formed at an earphone is inserted, and a slot cut in an upper surface thereof along a direction of insertion of the plug into the insertion hole so that the housing can be elastically deformed in a direction perpendicular to the insertion direction during the insertion of the plug, and a plurality of contact terminals, wherein one side of each contact terminal is disposed inside the insertion groove to contact with each terminal of the plug and the other side thereof is exposed to the outside of the housing to be connected to a circuit component.

6 Claims, 6 Drawing Sheets

EARPHONE JACK AND MOBILE TERMINAL HAVING THE SAME

Pursuant to 35 U.S.C. § 119(a), this application claims the benefit of earlier filing date and right of priority to Korean Patent Application No. 10-2004-0081898, filed on Oct. 13, 2004, the content of which is hereby incorporated by reference herein in its entirety.

BACKGROUND OF THE INVENTION

1. Field of the Invention

The present invention relates to an earphone jack and a mobile terminal, and more particularly, to an earphone jack and a mobile terminal having the same so as to enable a plug to be smoothly inserted into or pulled out of an earphone jack regardless of diameter variations of the plug and the earphone jack without providing an additional part.

2. Description of the Background Art

A mobile terminal is a communication device which permits the voice transmission and reception with an other party anywhere while a user portably carries it along. With the development of information and communication technologies, such a mobile terminal has not only a function of sending/receiving voice messages to/from the other party but also a function of sending/receiving image information.

Also, the mobile terminal is continuously being developed so as to have improved performance and exterior and various functions in response to the growing demand of consumers. Of the various functions, an earphone supporting function is being considered as an essential function of the mobile terminal. This is because as mobile terminals are commonly used due to developments of a wireless communication technology, the quality of communication is more importantly considered. In order for the high quality communication, an ear-microphone provided with both an earphone and a microphone is commonly used, so that a user may conveniently make a call by inserting (connecting) the ear-microphone into an earphone jack of the mobile terminal while driving or walking. Also, since an MP3 function of replaying downloaded music is additionally provided to a recently released mobile terminal, its user may listen to the music by connecting a headphone or a headset to the terminal.

In this specification, an earphone, an ear-microphone, a headphone, a headset, and the like will be collectively referred to as an earphone.

In general, a mobile terminal, a PDA, or the like is provided with an earphone jack to which a plug of an earphone is connected. The earphone jack and the plug are illustrated in exemplary views of FIGS. 1 and 2.

FIG. 1 is a perspective view which illustrates a conventional earphone jack and a plug before connection, and FIG. 2 is a plan view of FIG. 1.

As shown, a plug 10 integrally connected to an earphone includes a plurality of terminals 12, 13 and 14 which are electrically separated from one another by insulating portions 11 that are formed at a certain interval along a direction in which the plug 10 fits into the earphone jack 20. The illustrated plug 10 is a three pole plug, and the terminals 12, 13 and 14 may be a mike terminal, a speaker terminal and a ground terminal, respectively. Also, the terminals 12, 13 and 14 may be a first speaker terminal, a second speaker terminal and a ground terminal, respectively.

An earphone jack 20 into which the plug 10 fits includes a housing 21 formed as a rough rectangular parallelepiped shape and having at its center an insertion hole 22 into which the plug 10 can be inserted, and a plurality of contact terminals 23, wherein one side of each contact terminal 23 is disposed inside the insertion hole 22 to contact with each terminal 12, 13 and 14 of the plug and the other side thereof is exposed to the outside to be connected with a circuit component. The housing is commonly formed of a synthetic resin material.

The conventional earphone jack constructed in the aforementioned manner has the following problem.

First, a plug applied to a mobile terminal has a standardized diameter of 2.3±0.1 mm, and the insertion hole of the earphone jack is formed corresponding to the plug. Accordingly, if an outer diameter of the plug is 2.4 mm and an inner diameter of the insertion hole is 2.2 mm, namely, if the outer diameter of the plug is greater than the inner diameter of the insertion hole, the insertion itself cannot be made smoothly. Also, if the inner diameter of the insertion hole is greater than the outer diameter of the plug, the insertion is made smoothly but the contact between the terminals becomes loose, which may create noises or cause the earphone to be separated from the earphone jack all of a sudden.

Also, a special locking device may be additionally provided to prevent the sudden separation of the plug from the earphone jack. However, in this case, additional installation of the special locking device is not easy because of limited room within the housing and, manufacturing costs are increased and manufacturing processes become complicated.

SUMMARY OF THE INVENTION

Therefore, an object of the present invention is to provide an earphone jack and a mobile terminal having the same which enables a plug to be smoothly inserted into and pulled out of an earphone jack regardless of variations of an outer diameter of the plug and of an inner diameter of the insertion hole of the earphone jack without additionally providing a special part.

To achieve these and other advantages and in accordance with the purpose of the present invention, as embodied and broadly described herein, there is provided an earphone jack comprising: a housing having at its center, an insertion hole into which a plug formed at an earphone is inserted, and a slot cut in an upper surface thereof along a direction of insertion of the plug into the insertion hole so that the housing can be elastically deformed in a direction perpendicular to the insertion direction during the insertion of the plug, and a plurality of contact terminals, wherein one side of each contact terminal is disposed inside the insertion groove to contact with each terminal of the plug and the other side thereof is exposed to the outside of the housing to be connected to a circuit component.

To achieve these and other advantages and in accordance with the purpose of the present invention, as embodied and broadly described herein, there is provided a mobile terminal comprising: a case having a receiving space therein, and at its one side, a plug hole into which a plug of an earphone is inserted, a PCB received in the case and provided with a circuit component required for communication, a housing having at its center an insertion hole into which the plug is inserted, and a slot cut in its upper surface along a direction of the insertion of the plug into the insertion hole so that the housing can be elastically deformed in a direction perpendicular to the insertion direction during the insertion of the plug, and a contact terminal, wherein one side of the contact terminal is disposed inside the insertion hole to contact with each terminal of the plug and the other side thereof is exposed to the outside of the housing to be connected to a circuit component on the PCB.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A plurality of embodiments for a mobile terminal in accordance with the present invention may exist, but the most preferred embodiments will be described. The present invention may be employed in general sound supporting IT devices (e.g., mobile terminals, PDAs, portable computers, and the like), and of the devices, a folder type mobile terminal which is most commonly used will now be described as an example.

Figure 1:
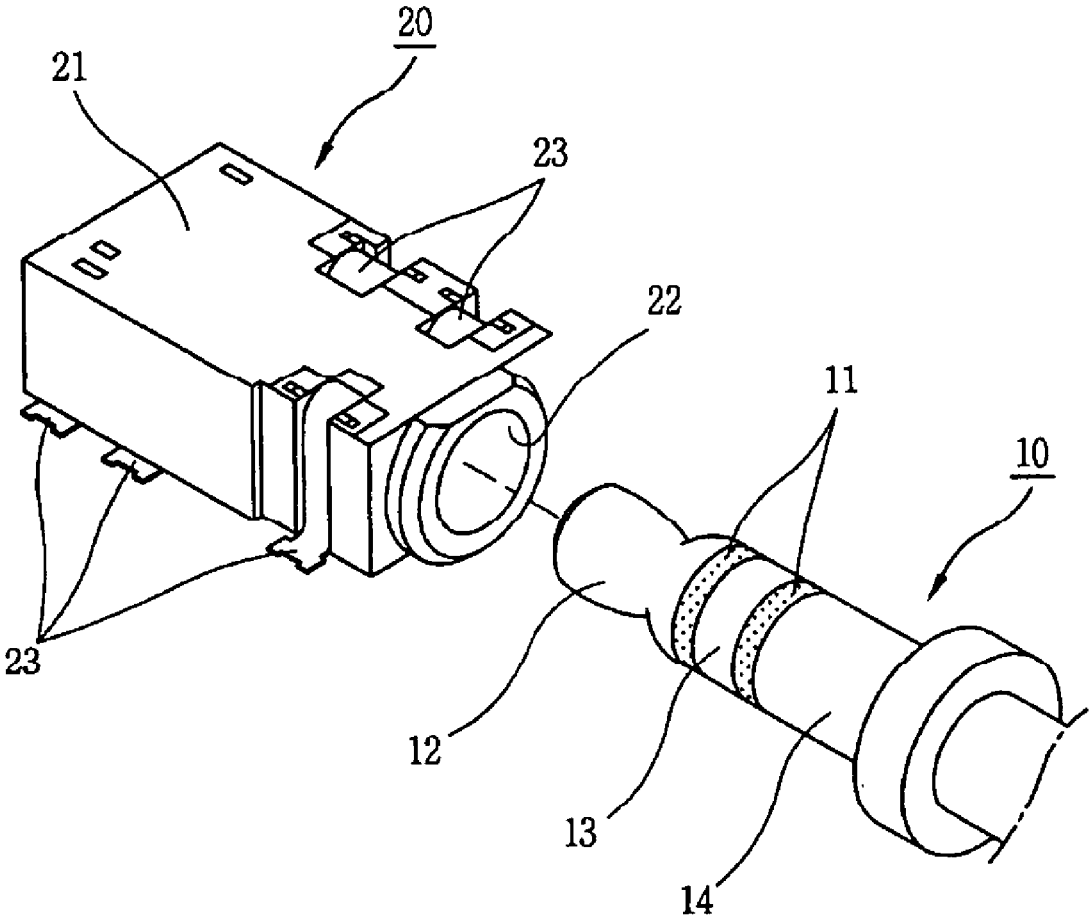
FIG. 1 PRIOR ART
FIG. 1 is a perspective view which illustrates a conventional earphone jack and a plug before connection.
Figure 2:
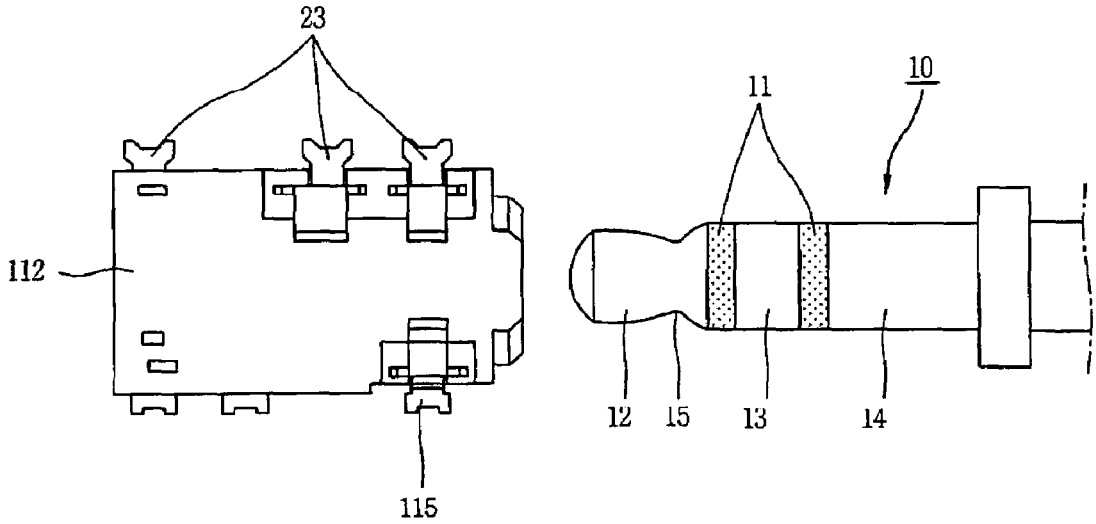
FIG. 2 PRIOR ART
FIG. 2 is a plan view of FIG. 1.
Figure 3:
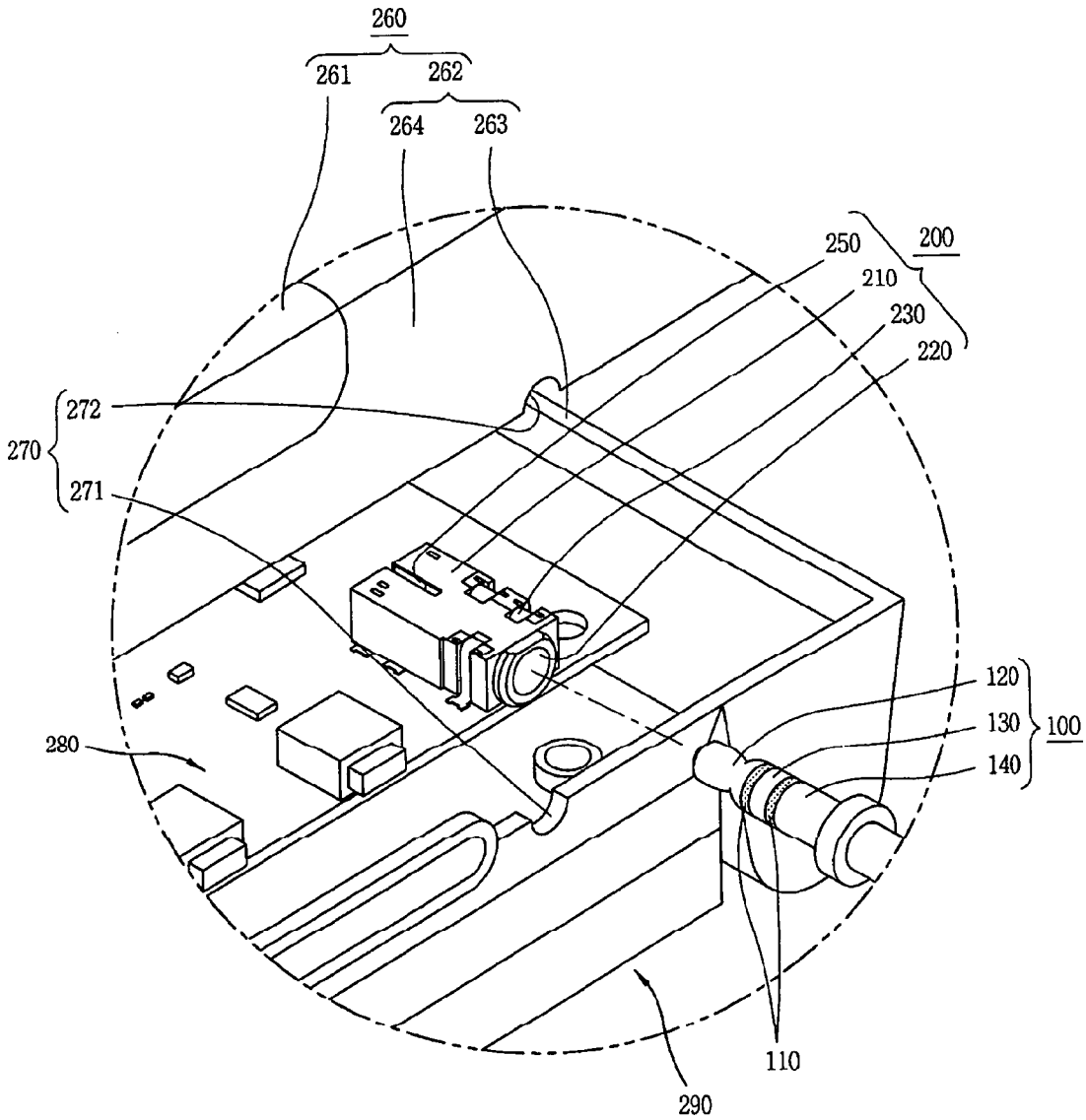
FIG. 3 is a perspective view which illustrates a plug and a housing of a mobile terminal before connection in accordance with a first embodiment of the present invention.
Figure 4:
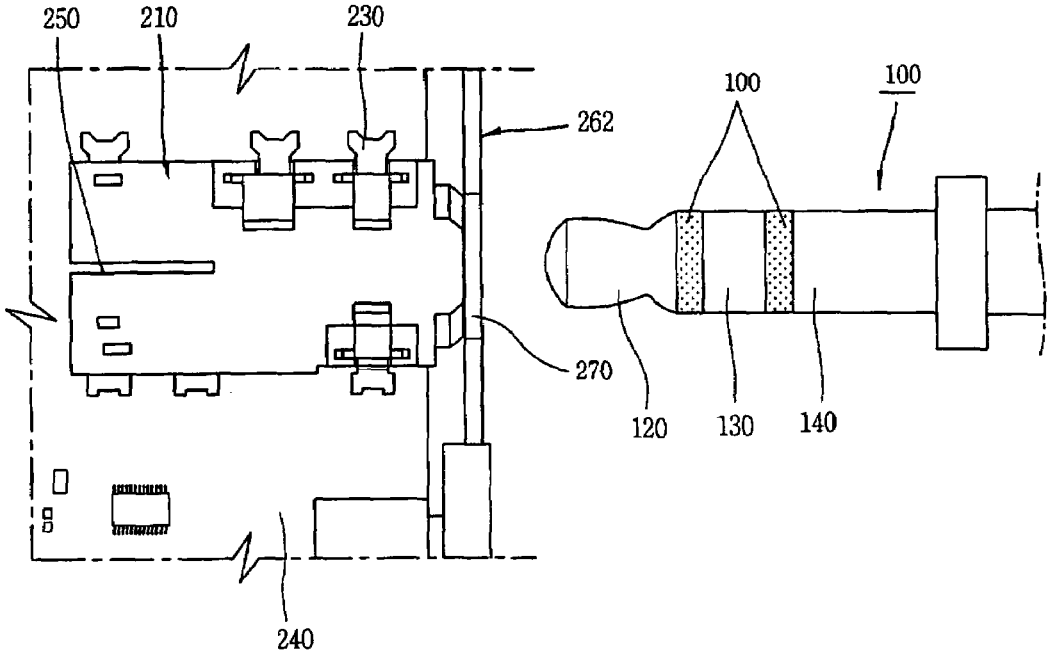
FIG. 4 is a plan view which illustrates the plug and an earphone jack in accordance with the first embodiment of the present invention.

FIG. 3 is a plug and a housing of a mobile terminal before connection in accordance with the first embodiment of the present invention, and FIG. 4 is a plan view which illustrates a plug and an earphone jack in accordance with the first embodiment of the present invention.

As shown, the mobile terminal having an earphone jack in accordance with the present invention includes an upper folder 290 and a lower folder 260 which are coupled to be rotatable relative to each other.

The lower folder 260 includes a case 262 forming a receiving space therein, a PCB 280 received within the case 262, and a battery 261 detachably coupled to a rear surface of the case 262.

The case 262 includes a front case 263 and a rear case 264 coupled to each other along the thickness direction, and first and second plug holes 271 are respectively formed at one side of the front case 263 and one side of the rear case 264 to complementarily form a plug hole 270 into which the plug is 100 inserted.

The plug 100 has insulating portions 100 formed at a certain interval along a direction that the plug 100 is inserted into the earphone jack 200, and a plurality of terminals 120, 130 and 140 which are electrically separated from one another by the insulating portions 110. Like the conventional art, the illustrated plug 100 is a three-pole plug, and the terminals 120, 130 and 140 may be a mike terminal, a speaker terminal and a ground terminal, respectively or may be a first speaker terminal, a second speaker terminal and a ground terminal, respectively.

The earphone jack 200 is provided with an insertion hole 220 which is formed at its center and which the plug 100 of the earphone is inserted into. The earphone jack 200 includes a housing 210 having a slot 250 cut in an upper surface thereof along a direction that the plug 100 is inserted into the insertion hole 220 so that the housing 210 is elastically deformed in a direction perpendicular to the insertion direction during the insertion of the plug 100, and a plurality of contact terminals 230, wherein one side of each contact terminal 230 is disposed inside the insertion hole 220 to contact with each terminal 120, 130 and 140 of the plug 100, and the other side thereof is exposed to the outside of the housing 210 to be connected to a circuit component on the PCB 280.

The slot 250 is formed by being cut to a predetermined length in an upper surface of the housing 210 from a end portion of a side opposite to a direction of insertion of the plug 100 into the jack 200.

The effects and operations of the present invention will now be described.

Figure 5:
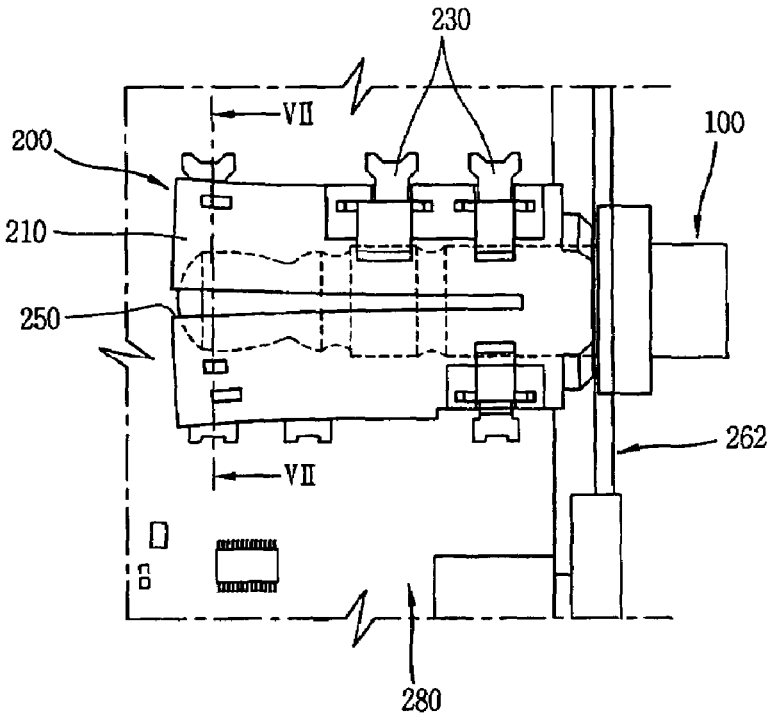
FIG. 5 is a perspective view which illustrates the plug and the housing of the mobile terminal after connection in accordance with the first embodiment of the present invention.
Figure 6:
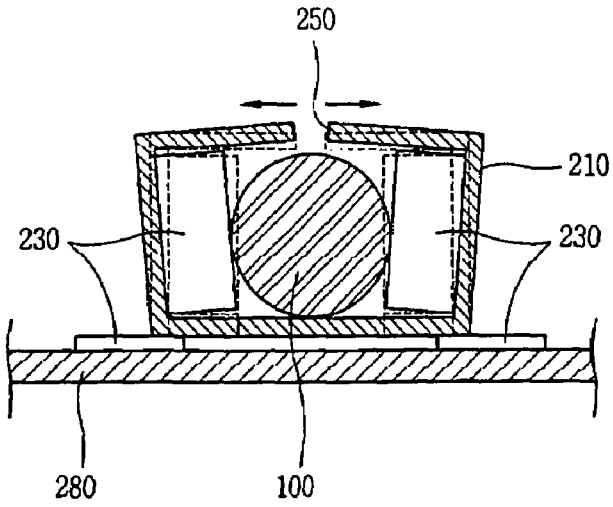
FIG. 6 is a sectional view taken along line VI—VI of FIG. 5.

FIG. 5 is a perspective view which illustrates a plug and a housing of the terminal in accordance with the first embodiment of the present invention after connection, and FIG. 6 is a sectional view taken along line VI—VI of FIG. 5.

As shown, if an inner diameter of the insertion hole formed at the earphone jack 200 is smaller than a diameter of the plug 100, the plug 100 cannot be smoothly inserted thereinto in the conventional art. However, in the present invention, the slit 250 becomes wider and accordingly, the housing 210 is elastically deformed in a direction perpendicular to the direction of insertion of the plug 100 into the insertion hole, thereby facilitating the insertion of the plug 100. Also, because the plug 100 is inserted in the earphone jack 200 with the slot 250 widened, the plug 100 can be supported in a direction of an inner diameter of the insertion hole, so that the connection between the contact terminal and the plug 100 is secured and sudden disconnection therebetween can be prevented.

Figure 7:
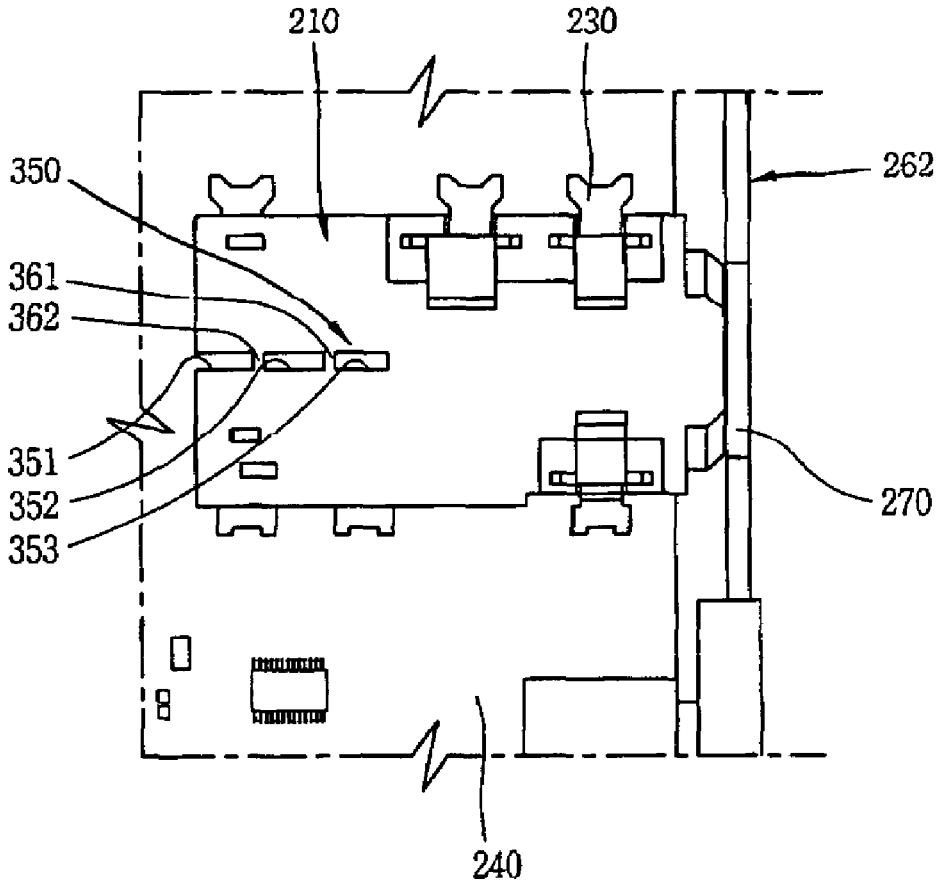
FIG. 7 is a plan view which illustrates an earphone jack in accordance with a second embodiment of the present invention.

FIG. 7 is a plan view which illustrates an earphone jack in accordance with a second embodiment of the present invention. As shown, the slot 350 is intermittently cut to a predetermined length in an upper surface of the housing 210 from an end portion of a side opposite to the direction of insertion of the plug into the insertion hole. Namely, first and second connection portions 361 and 362 are formed at the slot 350 at a predetermined interval along a lengthwise direction of the slot so as to divide the slot 350 into first, second and third slot portions 351, 352 and 353.

The first and second connection portions 361 and 362 may be formed as an elastic body, and also the entire housing 210 may be formed as an elastic body.

Preferably, the connection portions 361 and 362 and the slot portions 351, 352 and 353 are formed by a punching operation in a state that the housing 210 is put on a mold.

As a matter of course, the number of connection portions and slot portions may be varied.

By the second embodiment of the present invention, the slot 250 becomes wider and accordingly the housing 210 is elastically deformed in a direction perpendicular to that of the insertion of the plug 100 into the earphone jack, thereby facilitating the insertion of the plug 100. In addition, as they adhere more closely to each other by the elastic force of each of the connection portions 361 and 362, the connection between the contact terminals and the plug 100 is secured, and the sudden disconnection therebetween may be also prevented.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A mobile terminal comprising:

a case having a receiving space therein, and at its one side, a plug hole into which a plug of an earphone is inserted;

a housing having an insertion hole into which the plug is inserted, and a slot along a direction of the insertion of the plug, wherein the housing has an open side opposite the insertion hole, and wherein the slot has one end terminating at the open side of the housing thereby allowing the housing to be elastically deformed in a direction perpendicular to the insertion direction when the plug is inserted into the insertion hole.

2. The terminal of claim 1, further comprising:

a Printed Circuit Board received in the ease and provided with a circuit component required for communication; and a contact terminal, wherein one side of the contact terminal is disposed inside the insertion hole to contact with each terminal of the plug and the other side thereof is exposed to the outside of the housing to be connected to the circuit component on the PCB.

3. The terminal of claim 1, wherein the slot is formed by being cut to a predetermined length in an upper surface of the housing from the open side.

4. The terminal of claim 1, wherein the slot includes a connection portion formed intermittently on the slot and dividing a slot space.

5. The terminal of claim 1, wherein the connection portion is formed in plurality.

6. The terminal of claim 1, wherein the connection portion is an elastic body.

* * * * *